US005782700A

United States Patent [19]

Haas

[11] Patent Number: 5,782,700

[45] Date of Patent: Jul. 21, 1998

[54] GOLFING TARGET RINGS

[76] Inventor: Edward Franklin Haas, 840 Diana Pl. NE., Albuquerque, N. Mex. 87123

[21] Appl. No.: 766,944

[22] Filed: Dec. 16, 1996

[51] Int. Cl.[6] ..... A63B 69/36

[52] U.S. Cl. ..... 473/195; 473/162; 473/172

[58] Field of Search ..... 473/196, 197, 473/162–164, 170, 172, 195

[56] References Cited

U.S. PATENT DOCUMENTS

| | | | |
|---|---|---|---|
| 2,011,146 | 8/1935 | Evans | 473/172 |
| 2,235,358 | 3/1941 | Connell | 473/196 |
| 2,701,140 | 2/1955 | Fortino . | |
| 3,027,163 | 3/1962 | Saatzer . | |
| 3,081,090 | 3/1963 | Congleton . | |
| 3,231,280 | 1/1966 | Collins | 473/195 |
| 3,350,099 | 10/1967 | Smart | 473/172 |
| 3,464,703 | 9/1969 | Vallas . | |
| 3,490,769 | 1/1970 | Torbett . | |
| 3,649,027 | 3/1972 | Vallas . | |
| 3,752,482 | 8/1973 | Cassel . | |
| 3,966,212 | 6/1976 | Mason | 473/196 |
| 4,878,671 | 11/1989 | Gubany . | |
| 4,936,583 | 6/1990 | Peabody . | |
| 5,163,677 | 11/1992 | Foley . | |
| 5,257,800 | 11/1993 | Mueller . | |
| 5,435,560 | 7/1995 | Kehoe . | |
| 5,439,224 | 8/1995 | Bertoncino | 473/170 |
| 5,580,320 | 12/1996 | Meicle | 473/197 |

FOREIGN PATENT DOCUMENTS

| | | |
|---|---|---|
| 490717 | 2/1953 | Canada . |
| 2274066 | 1/1993 | United Kingdom . |

*Primary Examiner*—Mark S. Graham

[57] ABSTRACT

An improved golfing target device (11), as shown in FIG. (1), in the preferred embodiment having a flat, uniformly thick, substantially circular target area (10), being 1.12 meters (44 inches) in outer diameter, with a centered hole (1) approximately the 108 mm (4¼ inches) size of a regulation golf hole. Support device (2) causes target area (10) to be inclined toward the vertical with respect to the horizontal plane, with the lowest edge of target area (10) touching the same plane as the bottom of support device (2). Permanent attachment by rivets or weld maintains the position of target area (10) on support device (2). Flag pin receptacle (9) in the preferred embodiment is positioned properly and permanently attached, by rivets or weld, to the bottom of support device (2), which causes an inserted flag pin (6), with flag (6a), to protrude up thru the center of the golf size hole (1). Support device (2) in the preferred embodiment is of suitable strength and design to slide when pulled from the point of tow hook (3). Any golf car with a proper tow rope can be used to quickly move this permanent golf hole target device (11) to mow the grass, retrieve practice golf balls, or change the target distance from the tee-off line for different golfing club applications.

1 Claim, 3 Drawing Sheets

GOLFING TARGET RINGS

BACKGROUND OF THE INVENTION

The invention pertains to a moveable golfing target device that functions as a standard golf play hole, to allow golfers to practice all golfing shots, except putting, to improve their golfing accuracy.

BACKGROUND DISCUSSION OF PRIOR ART

Although the prior patents, appended with applicant's invention disclosure statement, disclose various kinds of golf configurations having a variety of golf hole targets, none of them individually or in combinations discloses or suggests applicant's moveable golf hole target device detailed below. The layouts disclosed in the golf driving range patents are permanent modifications of quite elaborate nature involving various obstacles and target configurations. While they offer the benefit of being weatherproof for constant exposure to all seasonal conditions, their complex designs would require substantial skills for installation, and be quite expensive and final. These obstacles include trees, sand traps, and water traps. Some disadvantages of these obstacles include difficult practice ball retrieval and specialized range maintenance. Target reconfiguration, to offer variety to practice distances, could nearly equal the installation costs for the patents that disclose underground ball returns and other fixed obstacles.

Known prior patents fail to disclose the desire to provide a moveable golfing target device, of proper design to be towed by a golf car. Additionally, according to Peter Davies in his dictionary of golfing terms, the four-wheeled electrically powered golf car came on the golf scene about 1960. This would suggest that prior to the introduction of the motorized golf car, inventors and their patents could not have intended using this powerful motorized car as a towing vehicle.

Although there are golf hole targets that could be moved, as in Connell (U.S. Pat. No. 2,234,358, issued Mar. 18, 1941) and Collins (U.S. Pat. No. 3,231,280, issued Jan. 25, 1966), they lack the simplicity and affordability of basic design and construction, and also lack the operational reliability, realized by the present invention, of having no moving parts to malfunction or fail. Another drawback of both patents is the elevation of their target areas above the practice surface. This elevation prevents practice shots that fall short of the target devices from rolling up onto the target area, which provides for realistic golf ball reaction and more accurate practice results, to closer simulate actual play. Additionally, neither of these prior patents disclose nor suggest the desire to use a regulation size flag pin, with flag, positioned in the center of the golf hole, to closely simulate a standard golf play hole. This flag pin would provide realistic golf ball reaction, if struck, and similar of the visual conditions to those found during actual play. Inventor Connell discloses a small symbolic flag, attached to the rear of the target device behind the hidden golf hole, which does not provide for either accurate golf ball reaction or proper visual simulation. Inventor Collins discloses a flag pin with no golf hole.

The remainder of the golf hole target devices, placed other than on golf driving ranges and disclosed in the other patents, mention non-durable materials of construction. This suggests the concern for light weight and small fixed size, with an apparent intent to offer mobility and ease of use for the individual golfer to store, transport, and select a site when practice is desired. These materials include canvas, plastic, sewn fabric, wicker mats, and thin flexible materials. Intense sunlight, high winds, and driving rain would likely deform or render useless these target devices, after a period of time, if they were permanently placed on a driving range. Additionally, if these golf hole targets were placed flat as designated, without being inclined toward the vertical with respect to the horizontal plane, at any distance greater than 80 yards they would be difficult or impossible to see because of same-plane geometry. No regulation size flag pin is disclosed or suggested for use by these patents.

OBJECTS AND ADVANTAGES

All these prior patents lack important advantages of applicant's invention: provision of a readily moveable, large, heavy, durable steel golfing target device, with no moving parts, that functions as a permanent, standard golf hole target, without permanent and expensive driving range modifications. The weatherproof golfing target device is impervious to high winds and extreme weather conditions when permanently situated on any golf driving range or other suitable area. The basic design, of welded and riveted coated steel construction, has no moving parts to malfunction, weaken, or fail. Being inclined toward the vertical with respect to the horizontal plane, the target area nearest to the practicing golfer touches the driving range surface. Known prior patents of moveable golf target devices that are inclined have target areas elevated above the practice surface. This elevation prevents any practice shots that fall short of the golf target device from rolling up onto the target area. Found prior patents of moveable golf target devices also fail to disclose the desire to provide a regulation size flag pin, with flag. This flag pin would most closely simulate visual and golf ball reaction conditions experienced during actual play. When frequent mowing and practice ball retrieval during range maintenance is required, the heavy golfing target device is easily towed away by the power of a golf car. This golf target removal overcomes the past problem of maintenance crews damaging their power equipment by striking anything that was permanently placed on the driving range. No know prior patents of golf target devices are of adequate design to be freely towed. The golfing target device, after maintenance is completed, can then be placed anywhere on the golf driving range. This provides endless target reconfiguration without additional modifications or expense. Nearly all of the existing patents for golf driving ranges have fixed-hole positions, and would be costly and time consuming to reconfigure.

Accordingly, it is an object of the present invention to provide a golfing target device for practicing golf shots, to develop accuracy when using any golfing clubs, other than what is commonly referred to as a putter.

Another object of the present invention is to provide a moveable golfing target device that functions as a permanent regulation size golf hole target, visible at any distance at which a practicing golfer would attempt to become proficient, and being impervious to any harsh weather conditions encountered during constant outdoor exposure.

Another specific object of the present invention is to provide a golfing target device with ease of mobility for frequent reconfigurations of the target, which affords an endless variety of different distances from which the golfer can practice, with no additional range modifications or costs.

A further object of the present invention is to provide a golfing target device with the target area nearest to the practicing golfer touching the driving range surface. This allows practice balls that fall short of the target device to roll up onto the target area for a possible hole-in-one, which provides for realistic golf ball reaction and yields more accurate practice results.

A still further object of the present invention is to provide the practicing golfer with the most realistic visual target and accurate golf ball reaction similar to actual golf play, by providing a regulation size flag pin in the center of the golf hole.

Another object of the present invention is to provide an affordable, durable, golfing target device that is simple in design and construction, and has no moving parts to malfunction, weaken, or fail.

These and other objects and advantages will be better understood and appreciated from a consideration of the drawings and ensuing description.

SUMMARY OF PRESENT INVENTION

The present invention is a moveable golfing target device that functions as a permanent, standard golf play hole. The invention is to be used by a golfer when practicing with all golf clubs, except the club referred to as the putter, to gain necessary golf skills to move the golf ball an exact, desired distance. The target area of the golfing target device has a hole in the center at least substantially equal in diameter to the regulation 108 mm (4¼ inches) size of a standard golf hole. The outer diameter is larger for visibility purposes, with the target area of the preferred embodiment having an outer diameter of 1.12 meters (44 inches), which is deemed adequate for good visibility for most practice purposes. The target area is inclined toward the vertical with respect to the horizontal plane, with the edge facing the practicing golfer touching the practice surface, which allows for golf balls that fall short to possibly roll up onto the target area. The target area is permanently attached to a support device, which in the preferred embodiment is of suitable strength and design to slide when pulled from a tow hook attachment point. A flag pin receptacle in the preferred embodiment is permanently attached to the bottom of the support device, which causes the flag pin, with flag, to protrude up thru the center of the approximately 108 mm (4¼ inches) hole.

DETAILED DESCRIPTION OF THE PREFERRED EMBODIMENT

Figure 1:
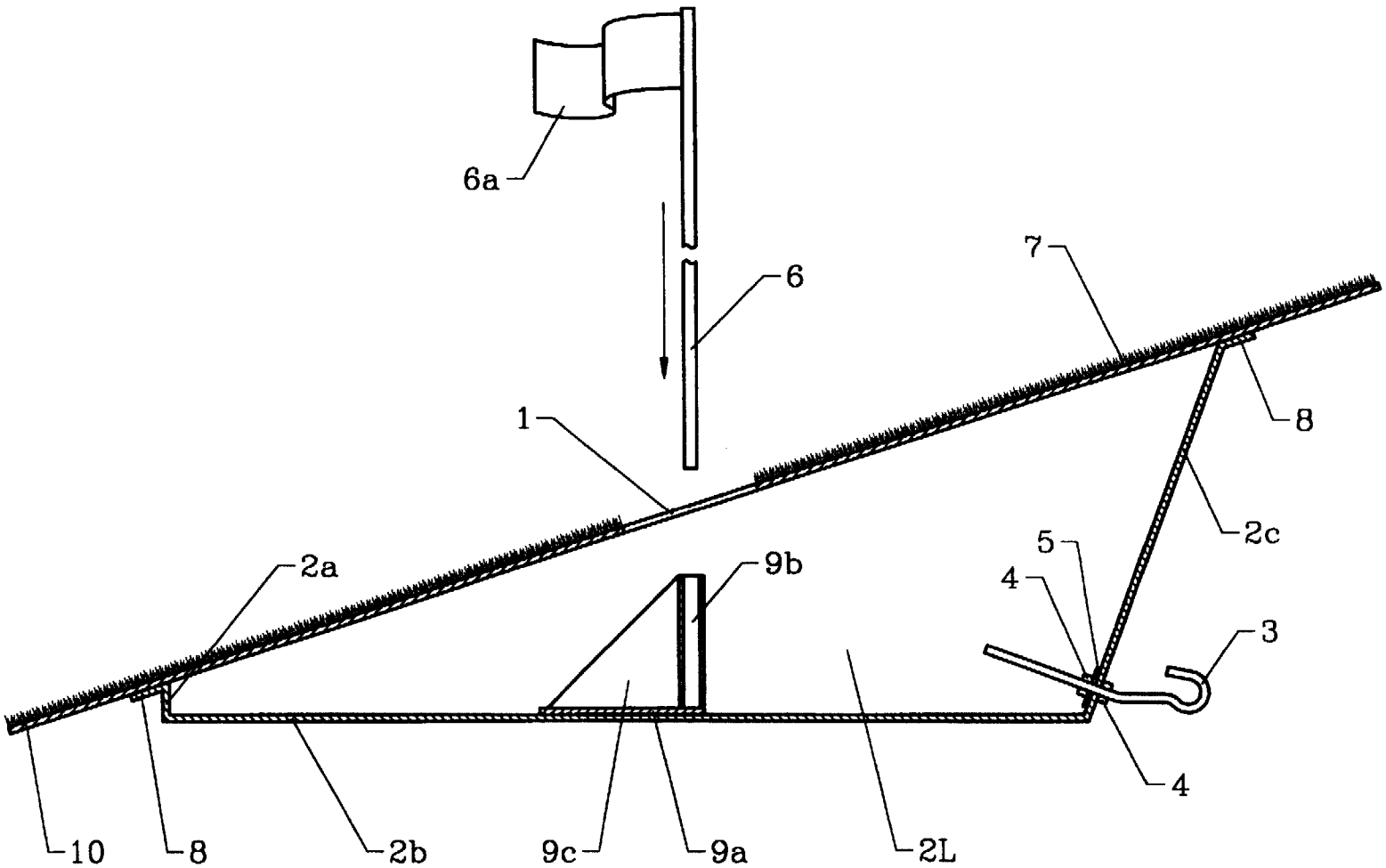
FIG. 1 is a cross-sectional view taken along a line 12—12 in FIG. 2 of the golfing target device, constructed in accordance with the present invention.

Referring now to the drawings, there is shown a preferred embodiment for the golfing target device of this invention. The golfing target device is described for the golfing practice application of all golfing shots not involving putting. The golfing target device of the present invention is particularly adapted for providing realistic visual conditions and golf ball reaction during practice, similar to those experienced during actual golf play. The golfing target device is characterized by an ability to be located on any surface a standard golf play hole might be found, including flat, contoured, or sloping ground.

Referring to FIG. 1 of the drawings, there is shown a cross-sectional view of a golfing target device 11 of the present invention. The top of golfing target device 11 is covered with a green artificial turf 7, simulating grass, which is permanently attached to a target area 10 with weatherproof adhesive. Target area 10 is a flat, galvanized sheet metal ring of uniform thickness, between 16 and 24 gauge, and being 1.12 meters (44 inches) in outer diameter, and having at the center a hole 1 with the diameter of 108 mm (4¼ inches), the regulation size of a standard golf hole. Target area 10 is attached at a sufficient number of points, by weld or rivets, to the 26 mm (one inch) flanges 8 that protrude outwards from a front 2*a*, a back 2*c*, and a side 2L and a side 2R of a support device 2. Target area 10 is permanently inclined toward the vertical with respect to the horizontal plane by support device 2, and target area 10 is mounted with its edge in front of front 2*a* touching the same plane as a bottom 2*b*. Support device 2 is comprised of 20 gauge galvanized sheet metal constructed in the following manner: a 51 mm (two inch) length, bent upwards at a 90 degree angle across the entire 615 mm (24 inch) width, forms a 26 mm (one inch) high front 2*a*, and provides for the 26 mm (one inch) front flange 8, which is bent outward at the proper angle to be parallel to target area 10. This single 615 mm (24 inch) wide piece then continues 718 mm (28 inches) from front 2*a* to form bottom 2*b*. An upward bend of approximately 70 degrees from the plane of bottom 2*b* travels 308 mm (12 inches) to form back 2*c*. The remaining 26 mm (one inch) is bent out ward from back 2*c*, at the proper angle to be parallel to target area 10, to form rear flange 8. The side 2L and the side 2R are of proper size and design to complete support device 2, and are permanently attached to the single bent piece, by a sheet metal bending process known as a pittsburgh seam. Both side 26 mm (one inch) flanges 8 are bent 90 degrees outward from support device 2 and are parallel with target area 10. All four flanges 8 of support device 2 are now on the same plane, which provides ample surface area for attachment purposes and the incline toward the vertical with respect to the horizontal plane of target area 10. This results in the rear of target area 10 being about 321 mm (12½ inches) above the front edge that touches the same plane as bottom 2*b*. The pittsburgh seam provides a union of sheet metal with near one-piece durability, but is not waterproof, which allows any rain or other moisture that enters the enclosed support device 2 through golf hole 1 to seep out. The 26 mm (one inch) flanges 8 of front 2*a*, back 2*c*, and sides 2L and 2R give extra angular support to the sheet metal sides of support device 2, and golfing target device 11 has abundant unit integrity when target area 10 is permanently attached to support device 2 with sufficient rivets or weld points.

Figure 3:
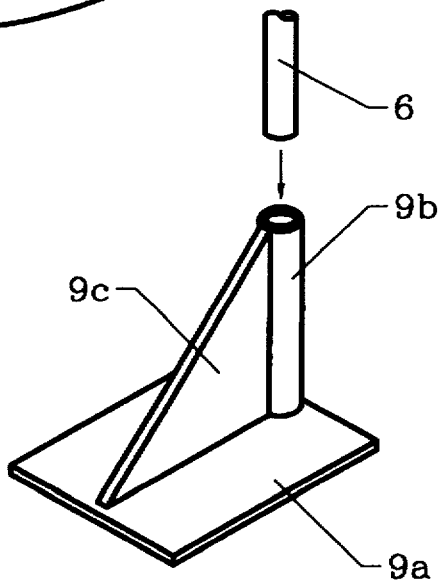
FIG. 3 is a perspective view, to show detail, of the flag pin receptacle of the golfing target device depicted in FIG. 1.

FIG. 3 show a perspective and detailed view of a flag pin receptacle 9, which is comprised of a 3 mm (⅛ inch) thick flat steel plate 9*a* 103 mm (4 inches) wide and 128 mm (5 inches) long. A 103 mm (4 inch) long section of steel pipe 9*b*, with a 13 mm (½ inch) inner and 19 mm (¾ inch) outer diameter, is positioned centered and inward from the 103 mm (4 inch) wide edge of, and then securely welded perpendicular to, plate 9*a*. The steel pipe 9*b* is reinforced by a 3 mm (⅛ inch) thick triangular flat steel gusset 9*c*, which has two sides 103 mm (4 inches) long that meet at a 90 degree angle. This gusset 9*c* is placed with the 90 degree angle at the perpendicular junction of plate 9*a* and pipe 9*b*, and is properly welded to both plate 9*a* and pipe 9*b*, which forms flag pin receptacle 9 shown in FIG. 3.

Figure 2:
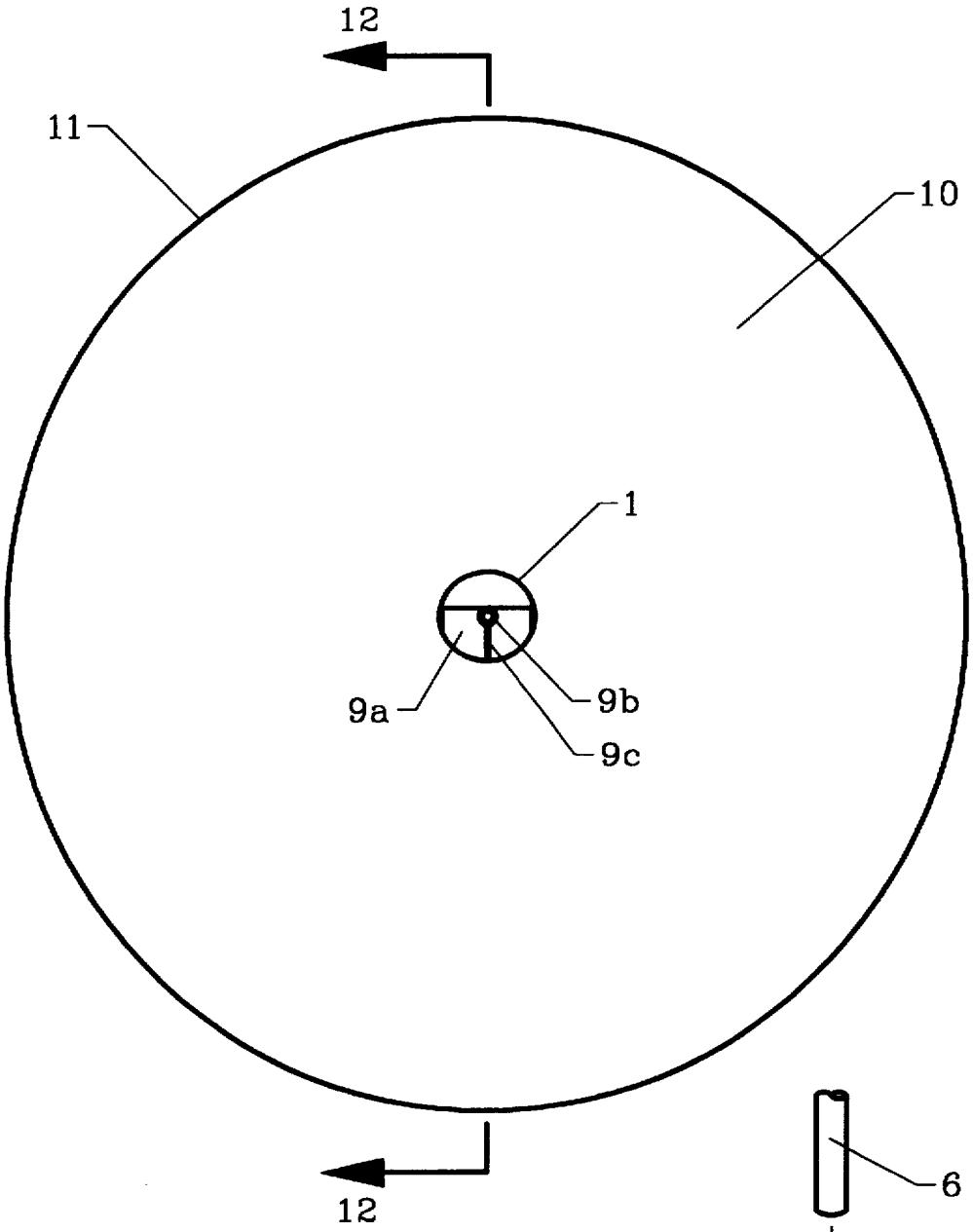
FIG. 2 is a top plan view of the golfing target device depicted in FIG. 1.

FIG. 1 shows a cross-sectional and FIG. 2 shows a top plan view, without artificial turf 7 for reason of clarity, of flag pin receptacle 9 properly positioned and permanently attached, by weld or rivets, to the bottom of support device 2. Pipe 9b causes an inserted flag pin 6, with a flag 6a, to be permanently held centered up thru golf hole 1. Flag pin 6 is a commercially available standard regulation 2.15 meter (7 foot) or greater length flag pole, with flag, having an adequate diameter to fit into steel pipe 9b.

Figure 4:
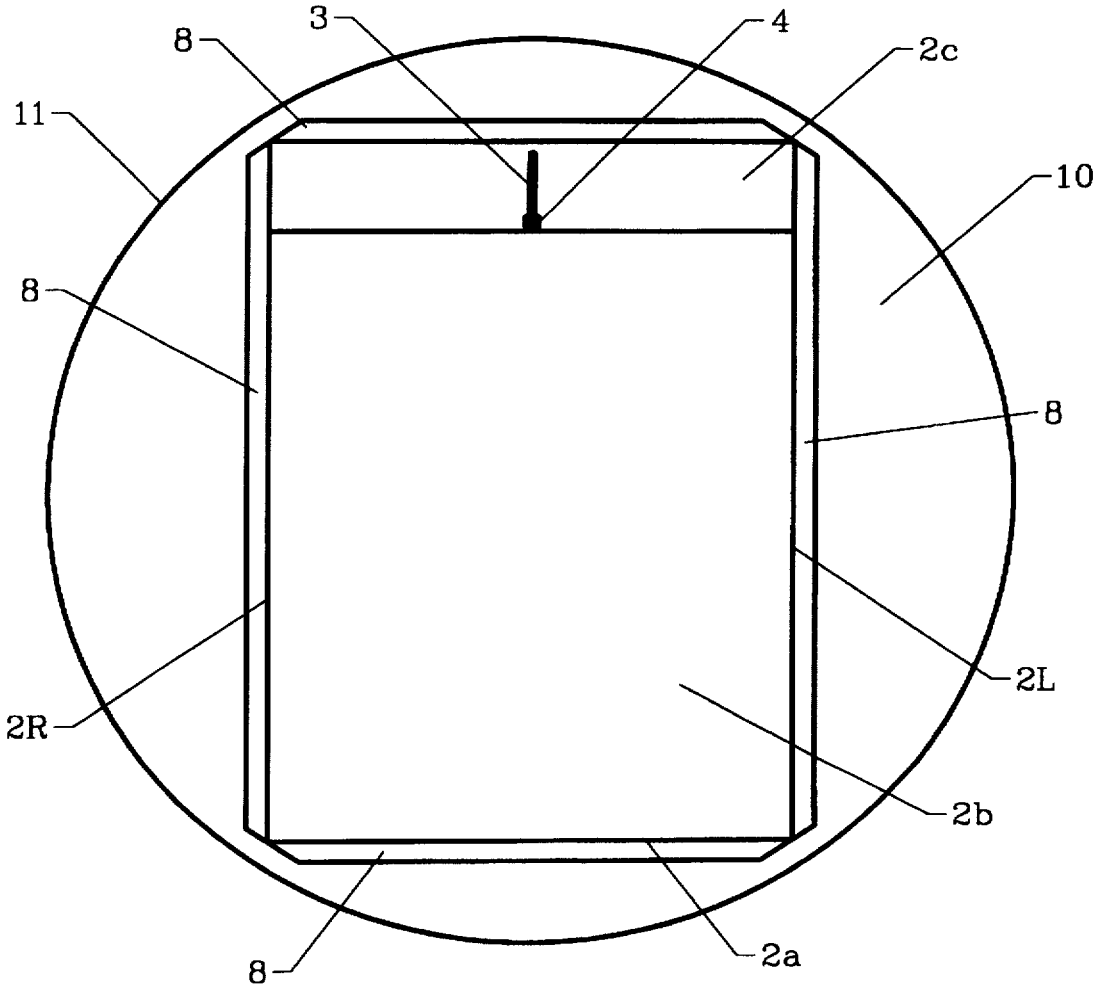
FIG. 4 is a bottom plan view of the golfing target device depicted in FIG. 1.

FIG. 1 and FIG. 4 show a 10 mm (⅜ inch) diameter 186 mm (7¼ inches) long threaded steel clothesline bolt, which is commercially available and is rebent properly to serve as a tow hook 3. A self-locking 10 mm (⅜ inch) square steel nut 4 is screwed onto the bolt until the end of the threads. An 11 mm (7/16 inch) hole is drilled in the center of back 2c one inch above the bottom of support device 2. Tow hook 3 is completely inserted in the 11 mm (7/16 inch) hole up to nut 4 from the outside of support device 2. From the inside of support device 2, a flat 10 mm (⅜ inch) steel fender washer 5 is placed on threaded tow hook 3 for towing stress reinforcement. Another 10 mm (⅜ inch) self-locking square steel nut 4 is screwed from the inside onto tow hook 3 and tightened completely, causing tow hook 3 to be locked into place. Tow hook 3 would be positioned with the hook up, as shown in FIG. 1, which prevents the tow rope loop from falling off if the tow rope goes slack. Any commercially available rope or chain (not shown) of sufficient length, strength, and design may be used to connect the golfing target device to a motorized golf car. One such design would be a fixed loop on one end of a 1.54 meter (five foot) length of 10 mm (⅜ inch) plastic rope, with a steel hook or other suitable connector on the other end of the rope, to attach to a golf car. This or any suitable tow rope would be used to pull golfing target device 11 when movement is required.

OPERATION

To prepare for use, golfing target device 11 is placed at the desired practice distance, with the edge of target area 10 that touches the practice surface facing the golfer. This provides for any practice golf shots that fall short of golfing target device 11 to possible roll up onto target area 10, and even possibly strike flag pin 6 and fall into golf hole 1.

To use the present invention for golfing target practice, the golfer visually selects any golfing target device 11 available at their desired practice distance and strikes the golf ball with the appropriate golfing club, attempting to accomplish a hole-in-one shot. Rarely will the practicing golfer get the golf ball in the center golf hole 1, accordingly, the principal objective is to touch any part of target area 10, which would be considered an excellent shot. Those skilled in the art would realize that any golfing shot of twenty-five yards or greater, with the practice ball coming to rest within a foot or two even if failing to touch target area 10, would be considered acceptable accuracy to all but the most discriminating golfers.

CONCLUSIONS, RAMIFICATIONS, AND SCOPE OF INVENTION

From the foregoing description, those skilled in the art would appreciate that all the objects of the present invention are realized. A golfing target device has been shown and described to allow for practice, with the goal of improved performance during actual golf play, by persons of nearly any age.

While my above descriptions contains many specificities, these should not be construed as limitations of the scope of the invention, but rather as an exemplification of one preferred embodiment thereof. Many other variations are possible. For example, although target area 10 of the preferred embodiment is white in color, for ready visibility and enhancement of target area 10 against the background of grass or soil where golfing target device 11 is placed, it would be possible to use other colors instead. For desert landscape application, or when the most accurate ball reaction is more desired than visual enhancement, target area 10 would be artificial green grass 7 covered, to simulate mini-greens.

Those familiar with the art will appreciate that although target area 10 of the preferred embodiment would be made, and not by way of limitation, of 16 to 24 gauge galvanized sheet metal, it would be possible to make target area 10 of any other type of suitable weatherproof or weather-resistant materials, without departing from the spirit of the invention.

Similarly, although target area 10 of the preferred embodiment has a hole 1 in the center which is the same 108 mm (4¼ inches) size as a standard regulation golf hole, it is not necessary to use that exact size. It is preferable that the hole size be at least substantially equal to 108 mm (4¼ inches) to correspond to the difficulty of a hole-in-one shot, although a size deviation of a few millimeters in either direction would not make a significant difference.

Although target area 10 of the preferred embodiment has an outer diameter of 1.12 meters (44 inches) in conjunction with being inclined toward the vertical with respect to the horizontal plane, which is deemed adequate for clear visibility of target area 10 up to a maximum distance of 180 yards, it is not critical that it be exactly of that diameter or exact shape, provided target area 10 has an outer diameter or area adequate for clear visibility at any distance it would be placed.

One skilled in the art would realize although support device 2 of the preferred embodiment would be made, and not by way of limitation, of 20 gauge galvanized sheet metal, it would be possible to use any other suitable design or type of suitable weatherproof or weather-resistant materials to incline target area 10 toward the vertical with respect to the horizontal plane.

Although flag pin receptacle 9 of the preferred embodiment would be made, and not by way of limitation, of 3 mm (⅛ inch) thick sheet steel welded to a steel pipe, it would be possible to use any material of adequate strength and design to support whatever size flag pin 6, and flag 6a, that was to be used. Similarly, although steel pipe 9b has an inner diameter of 13 mm (½ inch), it could be larger or smaller to accommodate any designated flag pole bottom.

Similarly, although flag pin 6, with flag 6a, in the preferred embodiment is a regulation size 2.15 meter (7 foot) or greater in height, it would be possible to use a shorter flag pin without departing from the spirit of the invention.

Although tow hook 3 is a 10 mm (⅜ inch) diameter 186 mm (7¼ inch) long clothesline bolt in the preferred embodiment, it would be possible to use any suitable means of attachment for towing or pulling purposes.

Having described the invention in detail, those skilled in the art will appreciate that modifications may be made of the invention without departing from its spirit. Accordingly, the scope of the invention should be determined not by the embodiment illustrated, but by the appended claims and their legal equivalents.

What is claimed is:

1. A golf target device for practice and play, comprising:

(1) a flat substantially circular ring of predetermined diameter and thickness;

(2) said ring having a centrally located hole approximately the size of a conventional golf hole;

(3) said ring being inclined toward the vertical with respect to the horizontal plane;

(4) said ring being attached by permanent means to a support device such that said rings' lowest edge touches the same plane the support device sets upon;

(5) said support device provides a receptacle for the perpendicular positioning of a conventional size flag pin, with flag, up through the center of said golf size hole;

(6) said support device has one side with a lower edge which slopes inward towards the centrally located hole, and upon which a tow hook is centered and permanently attached;

whereby any golf shot skills other than putting may be acquired, during practice or play sessions, by striking a golf ball with the appropriate golfing club in an attempt to touch the circular ring with a golf ball.

* * * * *